United States Patent [19]

Lugaresi

[11] 4,241,246

[45] Dec. 23, 1980

[54] THIN TOUCH TYPE SWITCH OF SEALED CONSTRUCTION

[75] Inventor: Thomas J. Lugaresi, Campbell, Calif.

[73] Assignee: Timex Corporation, Waterbury, Conn.

[21] Appl. No.: 947,122

[22] Filed: Sep. 29, 1978

[51] Int. Cl.[3] ..... H01H 3/12

[52] U.S. Cl. ..... 200/52 R; 200/5 A; 200/159 B; 368/286

[58] Field of Search ..... 58/23 B, 23 A, 50 R; 200/5 A, 159 B, 52 R; 368/286, 291, 292

[56] References Cited

U.S. PATENT DOCUMENTS

| | | | |
|---|---|---|---|
| 3,767,875 | 10/1973 | Schneikart et al. | 200/52 R |
| 4,158,115 | 6/1979 | Parkinson et al. | 200/5 A |

*Primary Examiner*—Gene Z. Rubinson
*Assistant Examiner*—Morris Ginsburg
*Attorney, Agent, or Firm*—Edward J. Timmer

[57] ABSTRACT

Disclosed is a sealed touch type switch of minimal dimensions adapted for ease of assembly into an electrical device. A flexible membrane with a conductive layer providing a depressible upper contact, an insulating and spacing member and optionally a stationary lower contact are preassembled in a sandwich construction, the flexible contact membrane and the insulating and spacing member having integral stem portions bonded together to define an insulated lead adapted to be bent for ease of final assembly. The switch may have a thickness as small as 0.010 inch and a diameter as small as 0.100—0.200 inch.

13 Claims, 5 Drawing Figures

THIN TOUCH TYPE SWITCH OF SEALED CONSTRUCTION

FIELD OF THE INVENTION

The present invention relates to touch type electrical switches in which a flexible membrane is utilized as a switching member and, more particularly to touch type switches having minimal dimensions, especially in the thickness direction, and having a sealed construction to prevent entry of dust or moisture.

DESCRIPTION OF THE PRIOR ART

With the widespread use of electronic calculators, watches and other similar apparatus, the development of compact electrical switches has been accelerated and has produced a wide variety of so-called touch-type switches which generally are single-pole, single-throw switches and comprise a stationary contact mounted for example on a circuit board or other substrate and a movable contact in the form of a flexible member, typically a thin electrically conductive plastic, metallic or composite membrane, spaced above the stationary contact and adapted to be depressed directly or indirectly by finger pressure to effect the momentary electrical contact desired in programming or activating such electronic apparatus. In the Larson patents, U.S. Pat. Nos. 3,995,126 and 4,034,176, issued Nov. 30, 1976 and July 5, 1977, respectively, the flexible member comprises a flat sheet of insulating material such as "MYLAR" plastic film and a flat conductive metallic foil laminated together. In the first issued Larson patent, plastic bubbles are mounted above the flexible member in registry with stationary contacts below the flexible member and are depressed by finger pressure to in turn depress the flexible contact member against a particular stationary contact. In the flexible contact member against a particular stationary contact. In the Boulanger U.S. Pat. No. 4,005,293 issued Jan. 25, 1977, a plastic film and thin metallic sheet in which dome-shaped contacts are struck are adhered together to form the flexible contact. This composite flexible contact is supported in spaced relation above and in registry with an array of stationary contacts by means of an insulating layer. In the Johnson U.S. Pat. No. 4,046,981 issued Sept. 6, 1977 and Kaminski U.S. Pat. No. 4,068,369 issued Jan. 17, 1978, a flexible metallic disc is held by an insulating film in position to act as an intermediate bridging contact between a conductive stationary ring and conductive center button. Overlying the metallic disc is a "MYLAR" plastic film for sealing purposes.

Other patents which are relevant to touch-type switches include the Shimoho U.S. Pat. No. 3,761,944 issued Sept. 25, 1973; Shimojo U.S. Pat. No. 3,728,509 issued Apr. 17, 1973; Yanaga U.S. Pat. No. 3,735,068 issued May 22, 1973; Webb et al U.S. Pat. No. 3,749,859 issued July 31, 1973; Shimojo et al U.S. Pat. No. 3,760,137 issued Sept. 18, 1973; Lynn et al U.S. Pat. No. 3,860,771 issued Jan. 14, 1975; DuRocher et al U.S. Pat. No. 3,879,586 issued Apr. 22, 1975; Suzumura U.S. Pat. No. 3,898,421 issued Aug. 5, 1975; Obata et al U.S. Pat. No. 3,932,722 issued Jan. 13, 1976; Larson U.S. Pat. No. 3,988,551 issued Oct. 26, 1976 and Zurcher U.S. Pat. No. 4,028,509 issued June 17, 1977.

In spite of these developments in touch type switches, there continues to be a need in the particular field of electronic watches, especially wristwatches, for a touch type switch which is not only small in diameter but also is of minimal thickness. In addition, the switch must provide an effective seal with the watch case to prevent ingress of dust or moisture. One touch type switch especially adapted for use in an electronic wristwatch is illustrated in the Schneikart et al U.S. Pat. No. 3,767,875 issued Oct. 23, 1973.

SUMMARY OF THE INVENTION

Accordingly, the present invention provides a touch type switch especially useful in electronic watch applications as a result of its minimal dimensions, especially thickness dimension, and sealed construction.

Typically, the touch type switch is used with electrical apparatus having an enclosure inside of which electrical circuitry is housed. The switch generally involves a sandwich construction of a stationary contact means, an insultating and spacing member and a flexible contact membrane in a recess in the enclosure of the electrical apparatus, the recess having an aperture at the periphery thereof providing access through the enclsoure to the internal circuitry. Typically, the recess is circular in outline and the stationary contact means comprises a metallic disc electrically bonded in the recess (the enclosure being the ground of the electrical circuitry). An important feature of the invention is that the insulating and spacing member comprises an annular portion disposed on the stationary contact means in sealed relation against the enclosure and a stem portion depending from the annular portion through the aperture. Another important feature of the invention is that the flexible contact membrane comprises an inner conductive layer, typically copper foil, and a resilient outer nonconductive layer bonded together, the membrane having a depressible contact portion, typically disc-shaped, supported on the annular portion of the insulating and spacing member in spaced relation above the stationary contact so that the inner conductive layer faces the stationary contact and can be brought into contact therewith by depressing the flexible member, and having a stem portion depending from the depressible portion through the aperture adjacent and bonded to the stem portion of the insulating and spacing member so that the inner conductive layer is sandwiched between insulating and nonconductive stem portions. In this way, the stem portions provide lead means by which the flexible contact membrane is connected to the internal circuitry. The stem portions are adapted to be bent at a preselected location for precise assembly of the switch in the electrical apparatus.

Typically, in assembling the touch type switch of the invention, the stationary contact disc, insulating and spacing member and flexible contact membrane are bonded together in a planar configuration and the bonded stem portions are thereafter bent in a preselected location and fashion to pass through the aperture into the interior of the enclosure. The inventive touch type switch provides a sealed single pole, single throw switch which can be as thin as 0.010 inch and can have a diameter as small as 0.100–0.200 inch.

DESCRIPTION OF THE DRAWINGS

Further objects and advantages of the invention will be better understood by reference to the following description, taken in connection with the accompanying drawing, in which.

DESCRIPTION OF THE PREFERRED EMBODIMENT

Although the touch type switch of the invention is described in detail hereinbelow with reference to an electronic wristwatch, it will be apparent that this is merely for purposes of illustration, rather than limitation, and that the inventive switch may find use in a wide variety of electronic apparatus where a single pole, single throw switch of minimal dimensions and sealed construction would be desirable.

Figure 1:
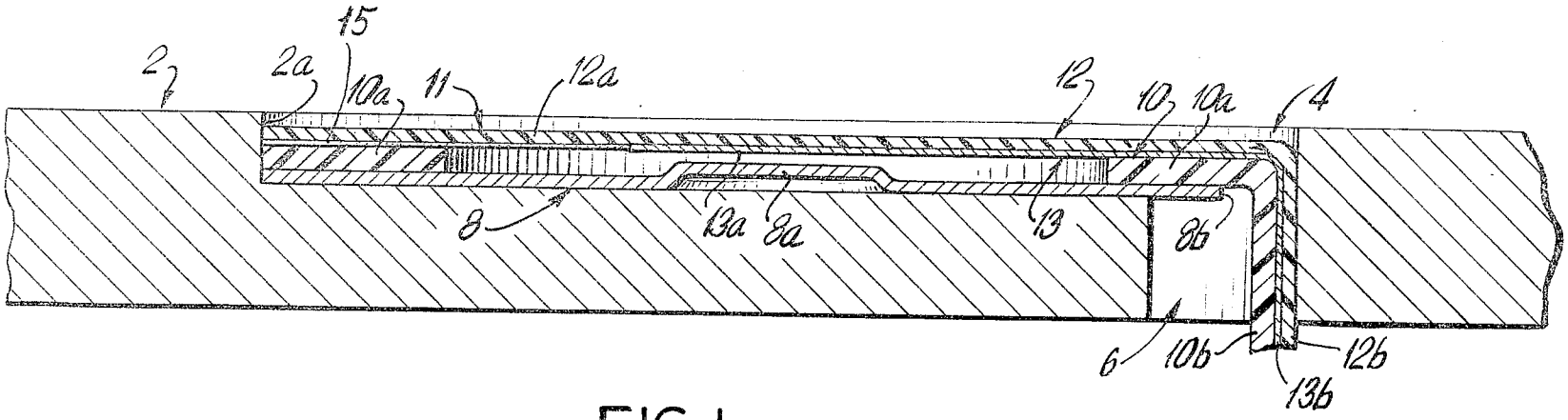
FIG. 1 is a partial cross-section of the touch type switch of the invention

FIG. 1 shows a watch case 2 having a wall 2a which defines circular recess 4 and aperture 6 through the case. Aperture 6 is disposed at the periphery of the recess and provides access to the internal watch circuitry (not shown). Typically, the recess 4 is 0.150 inch in diameter and 0.012 inch in depth while the aperture 6 has a diameter of about 0.030 inch. The watch case generally is made of a metal such as stainless steel, brass or the like and provides the ground for the watch circuitry. The switch includes a sandwich construction of a stationary contact plate 8 having a raised contact surface 8*a*, an insulating and spacing member 10 having an annular portion 10*a* and a stem portion 10*b* and a flexible contact membrane 11 having a resilient outer nonconductive layer 12 and inner conductive layer 13. As explained hereinbelow, these switch components are bonded together by thermoplastic adhesive to form a unit which is then inserted into recess 4.

Figure 2:
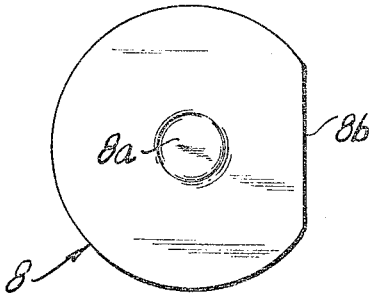
FIG. 2 is a plan view of the stationary contact plate or disc

Stationary contact means in the form of a beryllium-copper disc 8 is shown in FIG. 2. The disc 8 and raised contact surface 8*a* are generally circular in cross-section, the disc having a truncated side 8*b* so that the aperture 6 is not completely covered when the disc is placed in the recess as shown in FIG. 1. Typically, the disc is 0.137 inch in diameter and is 0.002 inch in thickness. The raised contact surface 8*a* is 0.030 inch in diameter and is raised 0.002 inch above the major disc surface.

Figure 3:
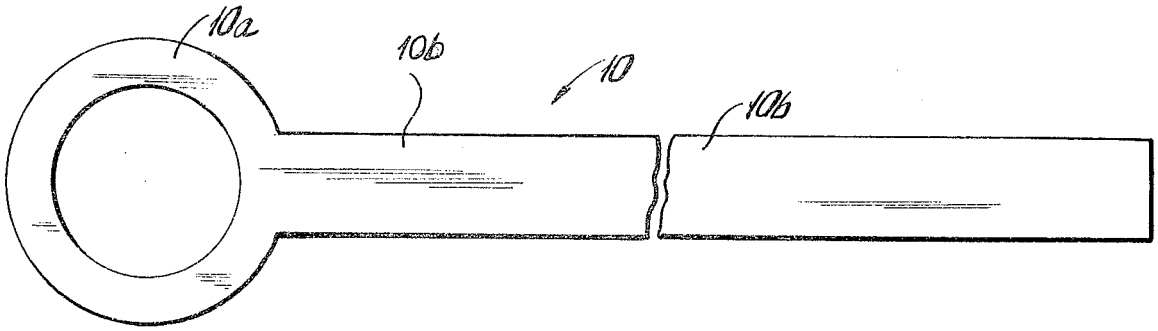
FIG. 3 is a plan view of the insulating and spacing member

FIG. 3 shows that the insulating and spacing member 10 comprises an annular portion 10*a* and laterally extending stem portion 10*b*. As illustrated in FIG. 1, annular portion 10*a* is adapted to rest on the periphery of stationary contact disc 8 in sealed relation against wall 2*a* which defines recess 4. In addition to providing the sealing function, annular portion 10*a* also acts to space the flexible contact membrane 11 the desired distance above the stationary contact disc and to insulate the contacts from one another. To this end, the insulating and spacing member is constructed of polyester material of 0.005 inch thickness. Of course, the outer diameter of annular portion 10*a* is selected to provide the desired sealing action against wall 2*a* whereas the inner diameter is selected to provide sufficient space into which flexible membrane 11 can be depressed to effect electrical contact. Outer and inner diameters of 0.137 inch and 0.090 inch are satisfactory for the embodiment described herein. Coated on both sides of the insulating and sealing member is a 0.001 inch thick layer of thermoplastic adhesive (partly shown) for bonding purposes also to be described in greater detail hereafter.

Figure 4:
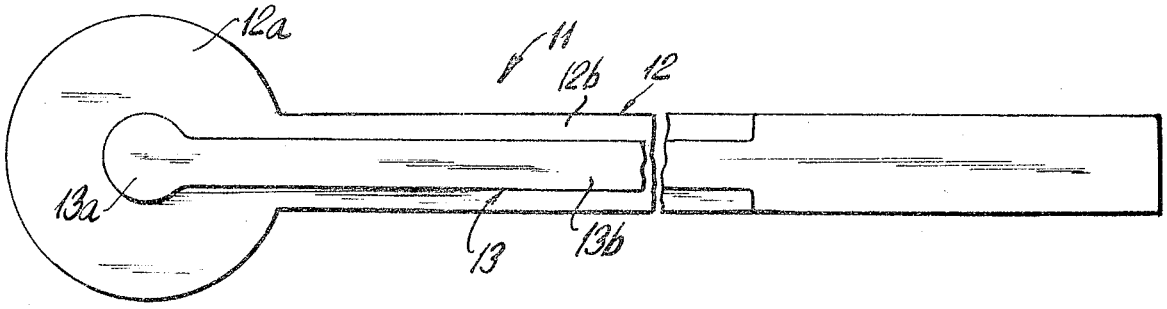
FIG. 4 is a plan view of the flexible contact membrane

The flexible contact membrane 11 is shown in FIG. 4 as comprising a planar disc-shaped portion 12*a* and laterally extending stem portion 12*b*, typically formed of a resilient outer nonconductive layer 12, such as "MYLAR" film of 0.003 inch thickness. The depressible portion 12*a* is 0.137 inch in diameter so that it completely spans recess 4, as shown in FIG. 1. Laminated to the resilient outer layer is an inner conductive layer 13 of for example copper foil of about 0.001 inch thickness. As can be seen in FIG. 4, the copper layer defines a depressible contact surface 13*a* of 0.050 inch diameter and stem portion 13*b*. Layers 12 and 13 are laminated by thermoplastic adhesive, although other means can of course be employed. Of course, it is apparent that, in FIG. 1, depressible portion 12*a* of membrane 11 is depressed to bring circular contact surface 13*a* into momentary contact with contact surface 8*a*, thereby performing the switching function.

Figure 5:
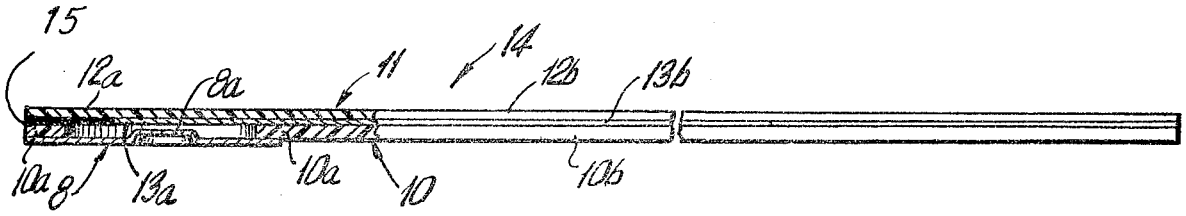
FIG. 5 is a cross-section of stationary contact plate, insulating and spacing member and flexible contact membrane bonded together prior to bending of the stem portions and insertion in the recess of the watch case.

As shown most clearly in FIG. 5, the stationary contact disc 8, insulating and sealing member 10 and flexible membrane 11 are preferably bonded together by means of the thermoplastic adhesive 15 on opposite sides of the member 10 to form a subassembly 14 for insertion into recess 4. However, prior to insertion, bonded stem portions 10*b*, 12*b*, and 13*b* are bent as a unit in a preselected location to the depending configuration illustrated in FIG. 1. In this way, when the subassembly is inserted in recess 4, the stem portions will pass through aperture 6 at the proper location into the interior of the watch case 2 for connection to the internal watch circuitry. The stem portions thus serve the function of a lead connecting the flexible contact to the circuitry. The stationary contact disc 8 is bonded to the bottom of recess 4 by conductive epoxy or the like to complete the circuit through the grounded watch case.

Thus it can be seen that a touch type switch of minimal dimensions and sealed construction is provided by the present invention. Such a switch will find special use in electronic wristwatches which have only limited space available for switches and also which must withstand moisture and dust penetration.

Although the stationary contact means has been described hereinabove with respect to a metallic disc bonded to the bottom of recess 4, other embodiments are of course possible. For example, the stationary contact means may comprise a planar disc-shaped portion and laterally extending stem portion similar to the flexible contact membrane 11, FIG. 4, with an outer conductive layer and inner nonconductive layer. Such a contact could be bonded to the subassembly of FIG. 5 such that the conductive layer faces the conductive layer 13 of the flexible contact membrane and the stem portions comprise a sandwich of two conductive layers, each between insulating and nonconductive stem portions. When inserted into recess 4 with the stem portions bent through the aperture 6, the two conductive layers insulated electrically from one another and from the case provide leads for connection to the internal circuit means. Of course, the stationary conductive layer on the bottom of the sandwich would be electrically insulated from the watch case by the inner nonconductive layer in contact therewith. In another embodiment, the stationary contact means may comprise the watch wall defining the bottom of the recess 4 and preferably a raised contact surface to mate with circular contact surface 13*a*.

Further, although the inventive switch has been described as having a circular or disc configuration, it will be apparent to those skilled in the art that non-circular shapes, such as oval, rectangular and the like can also be used. In these situations, the insulating and spacing member will have an annular portion in the particular noncircular shape selected. Of course, other modifications will occur to those skilled in the art and it is desired to cover in the appended claims all such modification as fall within the true spirit and scope of the invention.

I claim:

1. A touch type switch in combination with an electrical apparatus having an enclosure inside of which electrical circuit means is housed, said combination comprising:

(a) a wall of said enclosure defining a recess and an aperture near the periphery of the recess, the aperture providing access through the enclosure to said circuit means;

(b) stationary contact means in said recess and connected electrically to said circuit means;

(c) an insulating and spacing member comprising an annular portion disposed on the periphery of said contact means in sealed relation against the wall defining said recess except for a stem portion depending from the annular portion through said aperture;

(d) a flexible contact membrane comprising an inner conductive layer and outer resilient non-conductive layer bonded together, said membrane having a depressible contact portion supported on the annular portion of said insulating and spacing member in spaced relation above said contact means so that the conductive layer faces contact means and can be brought into contact therewith by depressing said membrane, and having a stem portion depending from said depressible contact portion in sealed relation against the wall defining said recess and extending through said aperture adjacent and bonded to the stem portion of said insulating and spacing member so that the conductive layer is sandwiched between the stem portions, whereby said stem portions provide lead means by which the depressible contact portion is connected to said circuit means.

2. The touch type switch of claim 1 wherein the recess is circular in cross section.

3. The touch type switch of claim 2 wherein the stationary contact means comprises a metallic disc having a truncated side and a raised central contact surface.

4. The touch type switch of claim 2 wherein the depressible contact portion of the flexible contact membrane includes a planar disc formed of the outer resilient nonconductive layer having a diameter sufficient to span said recess and a smaller concentric disc formed of the inner conductive layer thereon to form flexible contact means for engagement with the stationary contact means.

5. The touch type switch of claim 1 wherein the stationary contact means, insulating and spacing member and flexible contact membrane are bonded together as a unit by adhesive therebetween.

6. A touch type switch in combination with an electronic wristwatch having a watch case inside of which watch circuit means is sealed, said combination comprising:

(a) a wall of said watch case defining a recess and an aperture near the periphery of the recess, the aperture providing access through the case to said circuit means;

(b) stationary contact means disposed in said recess and connected electrically to said case which is the watch circuit ground;

(c) an insulating and spacing member comprising an annular portion disposed on the periphery of said contact means in sealed relation against the wall defining said recess except for a stem portion depending from the annular portion through said aperture;

(d) a flexible contact membrane comprising an inner conductive layer and outer resilient non-conductive layer bonded together, said membrane having a depressible contact portion supported on the annular portion of said insulating and spacing member in spaced relation above said contact means so that the conductive layer faces said contact means and can be brought into contact therewith by depressing said member and having a stem portion depending from said contact portion in sealed relation against the wall defining said recess and extending through the aperture adjacent and bonded to the stem portion of said insulating and spacing member so that the conductive layer is sandwiched between the stem portions, whereby said stem portions provide lead means by which the depressible contact portion is connected to said circuit means.

7. The touch type switch of claim 6 wherein the recess is circular in cross section.

8. The touch type switch of claim 7 wherein the stationary contact means comprises a metallic disc having a truncated side and a raised central contact surface.

9. The touch type switch of claim 8 wherein the metallic disc is electrically connected to the watch case by conductive adhesive.

10. The touch type switch of claim 6 wherein the depressible contact portion of the flexible contact membrane includes a planar disc formed of the outer resilient non-conductive layer having a diameter sufficient to span said recess and a smaller concentric disc formed of the inner conductive layer thereon to form flexible contact means for engagement with the stationary contact means.

11. The touch type switch of claim 6 wherein the stationary contact means, insulating and spacing member and flexible contact membrane are bonded together as a unit by adhesive therebetween.

12. A subassembly for a touch type switch which includes stationary contact means, the subassembly comprising:

(a) an insulating and spacing member comprising an annular portion adapted to be disposed on the stationary contact means and a stem portion extending laterally from said annular portion;

(b) a flexible contact membrane comprising an inner conductive layer and outer resilient nonconductive layer bonded together, said membrane having a depressible contact portion bonded and supported on the annular portion of said insulating and spacing member so that the conductive layer will face said stationary contact means when the subassembly is placed thereon and having a stem portion extending laterally from said depressible contact portion overlying and bonded to the stem portion of said insulating and spacing member so that the conductive layer is sandwiched between the stem portions, said stem portions providing lead means by which the flexible contact can be connected to electrical circuit means and being adapted to be bent in a preselected location to facilitate connection of the lead means to said circuit means.

13. The bonded subassembly of claim 12 which further includes said stationary contact means comprising a metallic disc, the disc being bonded to and supported beneath the annular portion of said insulating and spacing member as part of said subassembly.

* * * * *